US010947081B2

(12) United States Patent
Siwek et al.

(10) Patent No.: US 10,947,081 B2
(45) Date of Patent: Mar. 16, 2021

(54) APPARATUS FOR AND METHOD OF FOLDING AND WINDING A BAND OF NON-WOVEN FABRIC OF A PREDETERMINED LENGTH

(71) Applicant: AUTOMATEC Sp. z o.o., Lubań (PL)

(72) Inventors: Wojciech Siwek, Siemianowice Slaskie (PL); Artur Malejki, Olszyna (PL)

(73) Assignee: AUTOMATEC SP. Z O.O., Luban (PL)

( * ) Notice: Subject to any disclaimer, the term of this patent is extended or adjusted under 35 U.S.C. 154(b) by 0 days.

(21) Appl. No.: 16/508,455

(22) Filed: Jul. 11, 2019

(65) Prior Publication Data

US 2019/0330009 A1 Oct. 31, 2019

Related U.S. Application Data

(62) Division of application No. 15/641,718, filed on Jul. 5, 2017.

(30) Foreign Application Priority Data

Dec. 9, 2016 (PL) ..... 419756

(51) Int. Cl.
*B65H 54/58* (2006.01)
*B65H 45/12* (2006.01)

(52) U.S. Cl.
CPC ..... *B65H 54/585* (2013.01); *B65H 45/12* (2013.01); *B65H 2301/4474* (2013.01); *B65H 2701/18486* (2013.01)

(58) Field of Classification Search
None
See application file for complete search history.

(56) References Cited

U.S. PATENT DOCUMENTS 4,117,991 A * 10/1978 Johnson ..... B65H 54/56 242/398
4,783,948 A * 11/1988 Kando ..... B65H 54/62 53/119

(Continued)

FOREIGN PATENT DOCUMENTS

CN 105668045 A 6/2016
DE 2129148 A1 12/1971

(Continued)

OTHER PUBLICATIONS

European Search Report dated Mar. 26, 2018 in connection with the counterpart European Patent Application No. 17461559, citing the above reference(s).

(Continued)

*Primary Examiner* — Hemant Desai
*Assistant Examiner* — Tanzim Imam
(74) *Attorney, Agent, or Firm* — Hauptman Ham, LLP

(57) ABSTRACT

The present invention relates to an apparatus and a method for folding and winding a predetermined length of non-woven fabric used for the industrial production of moistened wipes. The apparatus for folding and winding a predetermined length of non-woven fabric from a roll wound on a core is mounted on a countertop, equipped with a housing, provided with a drive unit. Mounted on a hub (1) is a cylinder (2), to which eccentrically attached are rods (3) from which at a certain distance is mounted a linear feed (4). The hub assembly (1) with the cylinder (2) with the rods (3) and the linear feed (4) can be mounted vertically or horizontally.

1 Claim, 1 Drawing Sheet

(56) References Cited

U.S. PATENT DOCUMENTS

Figure 1:
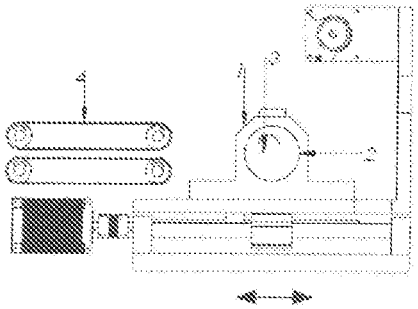

| | | | | |
|---|---|---|---|---|
| 5,531,660 | A | 7/1996 | Biese et al. | |
| 6,027,066 | A * | 2/2000 | Street | B65H 18/02 112/7 |
| 6,212,855 | B1 * | 4/2001 | Yasunaga | B65B 27/00 53/119 |
| 2011/0083795 | A1 | 4/2011 | Kowalewski et al. | |
| 2017/0036885 | A1 * | 2/2017 | Goodrich | B65H 75/30 |

FOREIGN PATENT DOCUMENTS

| | | | |
|---|---|---|---|
| EP | 2058257 | A1 | 5/2009 |
| EP | 2295260 | A2 | 3/2011 |
| FR | 2964376 | A1 | 3/2012 |
| PL | P.407961 | A1 | 10/2015 |
| WO | 2009111809 | A1 | 9/2009 |

OTHER PUBLICATIONS

Polish Search Report dated Mar. 21, 2018 in connection with the counterpart Polish Patent Application No. 3A19756, citing the above reference(s).

* cited by examiner

APPARATUS FOR AND METHOD OF FOLDING AND WINDING A BAND OF NON-WOVEN FABRIC OF A PREDETERMINED LENGTH

CROSS REFERENCE TO RELATED APPLICATION

The present application is a divisional application of U.S. patent application Ser. No. 15/641,718 filed on Jul. 5, 2017, which claims the benefit of the priority of Patent Application No. P.407961 filed on Apr. 22, 2014, in the Polish Patent and Trademark Office (PPO). The disclosures of the above-listed applications are hereby incorporated by reference herein in their entirety.

TECHNICAL FIELD

The subject of the invention relates to an apparatus for folding and winding a predetermined length of non-woven fabric used in the industrial production of moistened wipes.

From the description of Polish patent application no P-407961 entitled "Apparatus and method for changing bales, and guiding and controlling the continuity of a band of material in the process of moistening, folding and industrial moistening of disposable wipes", there is known an apparatus and method for changing bales, and guiding and controlling the continuity of a band of material in the process of moistening, folding and industrial moistening of disposable wipes used in manufacturing plants, in particular for the industrial stacking of liquid-moistened, single-layers of non-woven fabric of any grammage weight. The apparatus for changing bales, and guiding and controlling the continuity of a band of material in the process of moistening, folding and industrial moistening of disposable wipes consists of a bale change assembly and a folding assembly. The bale change assembly has a support frame on which is mounted a bale release mechanism. The moving bale of material is axially mounted to a tilted guide. The support frame is equipped with a sensor for measuring the amount of material. The support frame is equipped with a tower, at the top of which there is located a mechanism connecting bale ends in the form of a roller with a longitudinal latch, while below this mechanism is mounted a swing arm equipped with at least two drive rollers for folding, equalizing the band of material. Mounted to the tower is a sensor for monitoring the amount of the bale's material used, followed by a folding assembly equipped with a rack on whose arm is mounted a trolley driven by a stepper electro motor with screw travel, to which is mounted an opposing scrolling plate. Beneath there is the band of material's equalizing unit ending in a roller. Beneath the scrolling plate is located a sensor controlling the linear guiding of the band of material to determine the position of the fabric and the roller with a steel cylindrical element mounted perpendicularly to the roller's axis and the inductive sensor. Beneath there is located the material folding table. Also, described is the method of changing the bale of material in the process of moistening, folding and industrial moistening of disposable wipes.

The object of the present invention is to provide an apparatus and method for folding and winding a predetermined length of non-woven fabric, enabling the fabric to be precisely and quickly moistened, cut into sections and folded by an exact setting of the tension of the pulled material.

An apparatus for folding and winding a predetermined length of non-woven fabric from a roll wound on a core, mounted on a countertop, equipped with a housing, provided with a drive unit, is characterized in that mounted on a hub is a cylinder, to which rods are attached eccentrically, from which at a certain distance is mounted a linear feed.

Preferably, the hub and a cylinder assembly with rods and a linear feeder may be mounted vertically or horizontally.

A method of folding and winding a predetermined length of non-woven fabric from a roll wound on a core is characterized in that a band of material unrolled from a bale is inserted between rods, followed by a rotational movement of a cylinder, followed by the folding and cutting of the fabric by means of a knife, after which a hub and a cylinder assembly with rods is moved along in the direction of a linear feed, at which point the rods retract towards the cylinder, and the folded band of material is taken up by means of the linear feed.

By using the apparatus according to the invention, it is possible to precisely cut the material into sections by precisely arranging the surface and tension of the band of material on the rollers.

Figure 2:
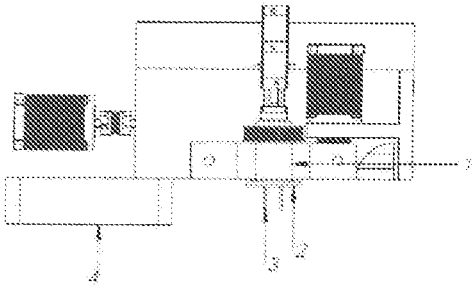
Figure 3:
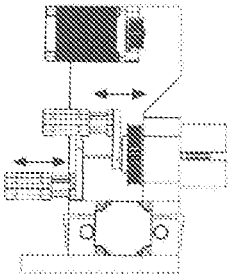

The subject of this invention is presented in an embodiment in the attached drawing, in which FIG. 1 shows a side view of the apparatus, and FIG. 2 shows a view of the folding table in perspective, FIG. 3 shows the folding table in operation mode.

An apparatus for folding and winding a predetermined length of non-woven fabric from a roll wound on a core, mounted on a countertop equipped with a housing, is provided with a drive unit. To a hub 1 is mounted a cylinder 2, to which eccentrically attached are rods 3, from which at a certain distance is mounted a linear feed 4. The hub assembly 1 with the cylinder 2 with the rods 3 and the linear feed 4, can be mounted vertically or horizontally.

A method of folding and winding a predetermined length of non-woven fabric from a roll wound on a core is characterized in that a band of a material W unrolled from a bale is inserted between rods 3, followed by cutting and the rotational movement of a cylinder 2, resulting in folding, followed by moving longitudinally a hub assembly 1 with the cylinder 2 with the rods 3 in the direction of a linear feed 4, followed by the rods 3 being retracted towards the cylinder 2, and the folded band of material W being taken up by means of the linear feed 4.

The invention claimed is:

1. A method of folding and winding a predetermined length of non-woven fabric from a roll wound on a core, the method comprising the steps of:

inserting a rolled out band of material between rods;

followed by cutting the band;

followed by rotationally moving a cylinder in order to fold the band;

followed by longitudinally moving a hub assembly, the cylinder, and the rods in a direction of a linear feed;

followed by retracting the rods toward the cylinder and taking up the folded band of material by means of the linear feed.

* * * * *